US009586108B1

(12) United States Patent
Siniscalchi

(10) Patent No.: US 9,586,108 B1
(45) Date of Patent: Mar. 7, 2017

(54) REMOVABLE OVERSIZED GOLF GRIP

(71) Applicant: Michael Siniscalchi, North Myrtle Beach, SC (US)

(72) Inventor: Michael Siniscalchi, North Myrtle Beach, SC (US)

( * ) Notice: Subject to any disclaimer, the term of this patent is extended or adjusted under 35 U.S.C. 154(b) by 0 days.

(21) Appl. No.: 14/940,491

(22) Filed: Nov. 13, 2015

(51) Int. Cl.
*A63B 53/14* (2015.01)

(52) U.S. Cl.
CPC ..... *A63B 53/14* (2013.01); *A63B 60/14* (2015.10); *A63B 60/06* (2015.10); *A63B 60/16* (2015.10)

(58) Field of Classification Search
CPC ..... A63B 53/14; A63B 60/14; A63B 60/06
See application file for complete search history.

(56) References Cited

U.S. PATENT DOCUMENTS

| | | | | |
|---|---|---|---|---|
| 1,498,382 | A | 6/1924 | Johnston | |
| 2,481,778 | A | 9/1949 | Pearson | |
| 3,375,891 | A * | 4/1968 | Murati | E21B 25/00 175/316 |
| 4,355,803 | A * | 10/1982 | Rama | A63B 60/02 473/519 |
| 4,438,925 | A | 3/1984 | Lindstrom | |
| 5,398,930 | A * | 3/1995 | Gibson | A63B 53/14 473/201 |
| 5,513,845 | A | 5/1996 | Sonagere | |
| 5,626,527 | A | 5/1997 | Eberlein | |
| 5,906,548 | A | 5/1999 | Hadge | |
| 5,954,591 | A | 9/1999 | Liberatore | |
| 6,036,607 | A | 3/2000 | Finegan | |
| 6,286,521 | B1 * | 9/2001 | Joulia | A45D 40/221 132/295 |
| 6,817,956 | B1 | 11/2004 | Dagenais | |
| 6,991,554 | B2 | 1/2006 | Ryan | |
| 7,294,063 | B2 | 11/2007 | Jacobs | |
| 7,927,236 | B2 | 4/2011 | Brunton et al. | |
| 2002/0173371 | A1 | 11/2002 | Lamkin et al. | |
| 2004/0185955 | A1 | 9/2004 | Rocconi | |
| 2011/0152017 | A1 * | 6/2011 | Mohr | A63B 49/08 473/549 |
| 2011/0165957 | A1 * | 7/2011 | Lu | A63B 53/14 473/298 |
| 2015/0352417 | A1 * | 12/2015 | Feehan | A63B 60/22 473/299 |

* cited by examiner

*Primary Examiner* — John E Simms, Jr.
(74) *Attorney, Agent, or Firm* — Jeffrey C. Watson; Grell & Watson Patent Attorneys

(57) ABSTRACT

A removable oversized golf grip includes a first grip portion, a second grip portion, and a locking mechanism. The first grip portion has a first interior and a first exterior. The second grip portion has a second interior and a second exterior. The locking mechanism removably joins the first portion to the second portion around a golf grip. Wherein, the first interior and the second interior create a combined interior configured to securely fit around the golf grip, and the first exterior and the second exterior create a combined exterior configured as an oversized golf grip.

14 Claims, 7 Drawing Sheets

REMOVABLE OVERSIZED GOLF GRIP

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The disclosure generally relates to grips for golf clubs, and namely to a removable oversized golf grip.

Description of the Related Art

The disclosure relates generally to a removable oversized golf grip, a method of using the same, and a method of manufacturing the same.

An oversized golf grip, like the Super Stroke Putter Grip available from SuperStroke USA of Wixom, Mich., was developed to help stabilize the putting stroke and reduce unwanted wrist action. Since its introduction to the market it has skyrocketed in popularity and is now ubiquitous in the golf community. However, the current oversized golf grips, like the Super Stroke Putter Grips, were developed exclusively for putters and the putting stroke.

Chipping and the chipping stroke is fundamentally the same as putting and the putting stroke. Many amateur golfers struggle with overactive hands that result in errant shots or flubs. As such, it is clear that an oversized golf grip for chipping is desired to help stabilize the chipping stroke similar to the oversized grips for putters.

However, unlike putting where the putter is used exclusively for putting, wedges and irons are not only used for chipping, but are also used for full swings or shots. Unlike the chipping and putting strokes, in full swings and shots, a standard golf grip is required to allow for proper setting and releasing of the golf club during the golf swing. As such, the instant disclosure recognizes the need/desire to have a removable oversized golf grip on short irons/wedges, like for temporary use just when chipping around the greens.

Therefore, it is readily apparent that there is a recognizable unmet need for a removable oversized golf grip that is quickly and easily installed and removed over an existing golf grip. The instant disclosure is designed to address at least some of the above mentioned problems by providing a removable oversized golf grip.

SUMMARY

Briefly described, in a preferred embodiment, the present apparatus, system, and method overcomes the above-mentioned disadvantages and meets the recognized need for such a device by providing a removable oversized golf grip that is quickly and easily installed and removed over an existing golf grip.

The present apparatus, system, and method include a removable oversized golf grip. According to its major aspects and broadly stated, the present disclosure describes a removable oversized golf grip that generally includes a first grip portion and a second grip portion. The first grip portion has a first interior and a first exterior. The second grip portion has a second interior and a second exterior. The first grip portion and the second grip portion are configured to be removably joined together around a golf grip, wherein the first interior and the second interior create a combined interior configured to securely fit around the golf grip, and the first exterior and the second exterior create a combined exterior configured as an oversized golf grip.

One feature of the removable oversized golf grip may be a locking mechanism for removably joining the first grip portion and the second grip portion. The locking mechanism may generally include a first connection and a second connection. The first connection may be configured for removably locking the first end of the first grip portion to the first end of the second grip portion. The second connection may be configured for removably locking the second end of the first grip portion to the second end of the second grip portion.

In select embodiments, the first connection may include a protrusion from the first end of the first grip portion with an opening therein. In addition, an extension may be included around the first end of the second grip portion with a space configured to receive the protrusion from the first end of the first grip portion. A cap may also be included that is configured to be inserted into the extension on the first end of the second grip portion and to engage the opening in the protrusion from the first end of the first grip portion on the other side of the extension in the first end of the second grip portion.

In select embodiments, the cap may generally include a tab biased toward the opening in the protrusion from the first end of the first grip portion and a lever for moving the tab. The tab may be biased toward the opening in the protrusion from the first end of the first grip portion on the other side of the extension in the first end of the second grip portion for locking the protrusion of the first grip portion in the extension of the second grip portion. The lever may be configured for moving the tab downwards from the cavity and releasing the protrusion of the first grip portion in the extension of the second grip portion.

In select embodiments, the second connection may generally include a flange from the second end of the second grip portion, and a cavity on the second end of the first grip portion. The cavity may be configured to receive the flange from the second end of the second grip portion. Whereby, when the first grip portion and the second grip portion are slid together around the golf grip, the first connection and the second connection may simultaneously come together, where the flange from the second grip portion enters the cavity on the first grip portion on the second ends, and the protrusion from the first grip portion enters the space in the extension of the second grip portion on the first ends.

Another feature of the removable oversized golf grip may be that the oversized golf grip created by the combined exterior may include a standard golf grip material.

Another feature of the removable oversized golf grip may be that the oversized golf grip created by the combined exterior may include a circular or substantially circular cross-section. In select embodiments, the circular or substantially circular cross-section may have a diameter of at least 1.00 inches. In other select embodiments, the diameter may be between 1.00 inches and 2.00 inches. In yet, other possibly preferred embodiments, the diameter may be approximately 1.2 inches.

Another feature may be that the circular or substantially circular cross-section may include at least one flat portion. In select embodiments, the at least one flat portion may include a flat top portion.

Another feature of the removable oversized golf grip may be that the combined interior may include a flexible material. The flexible material of the combined interior may be configured to conform securely around various sizes of the golf grip. For example, the flexible material of the combined interior may be configured to conform securely around a 0.90 inch diameter golf grip. In select embodiments, the flexible material may be memory foam.

One feature of the instant disclosure may be a golf club grip system for the shaft of a golf club that includes any of the various embodiments of the removable oversized golf grip as shown and/or described herein. The golf club grip system may generally include a golf grip installed on the shaft of a golf club, and the removable oversized golf grip configured to be removably installed over the golf grip installed on the shaft of the golf club. Wherein, when installed the removable oversized golf grip creates an oversized golf grip on top of the golf grip installed on the shaft of the golf club.

In use, a method of temporarily increasing the size of a golf grip installed on the shaft of a golf club may be carried out utilizing any of the various embodiments of the removable oversized golf grip as shown and/or described herein. In general, the method of temporarily increasing the size of a golf grip installed on the shaft of a golf club may include providing the removable oversized golf grip in any of the various embodiments shown and/or described herein. The removable oversized golf grip may be configured to be removably installed over the golf grip installed on the shaft of the golf club. The method then includes removably attaching the removable oversized golf grip over top of the golf grip installed on the shaft of the golf club. Wherein, when installed, the removable oversized golf grip creates an oversized golf grip on top of the golf grip installed on the shaft of the golf club.

These and other features of the removable oversized golf grip will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present removable oversized golf grip will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-8 by way of example, and not limitation, therein is illustrated an example embodiment of removable oversized golf grip system 100 with removable oversized golf grip 10. Oversized golf grip 10 may be quickly and easily installed and removed over golf grip G on shaft S of club C. Club C may be any desired club for installing a removable or temporary oversized golf grip, including, but not limited to, any irons, wedges, woods, drivers, putters, etc. For example, oversized golf grip 10 may be quickly and easily installed on a short iron or wedge for chipping around the green. Once, the chipping process is complete, oversized golf grip 10 may be quickly and easily removed for regular use of the short iron or wedge with standard grip G.

Figure 1:
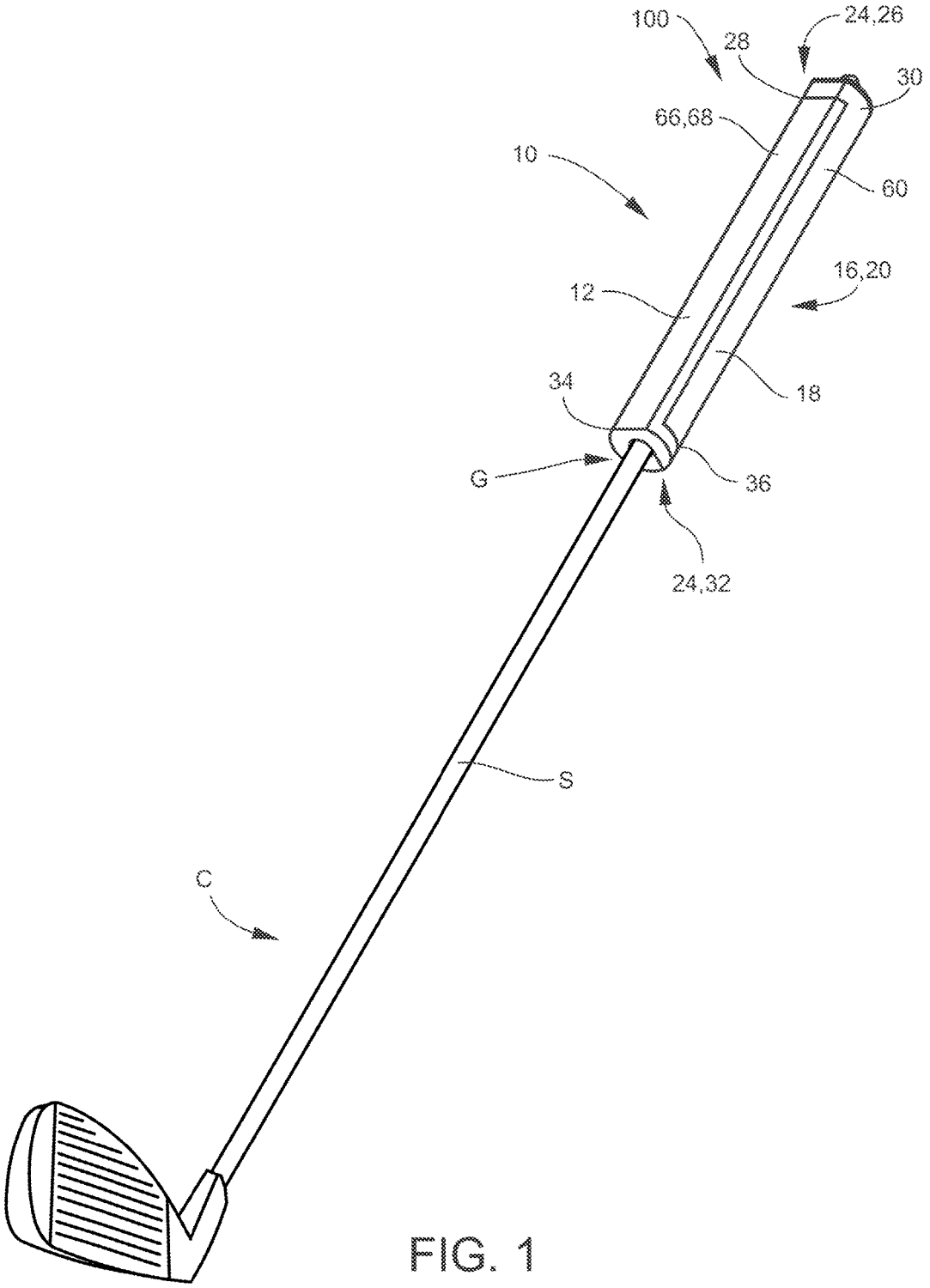
FIG. 1 is a perspective view of an exemplary embodiment of the removable oversized golf grip and system according to the instant disclosure installed over an existing golf grip of a golf club.
Figure 2:
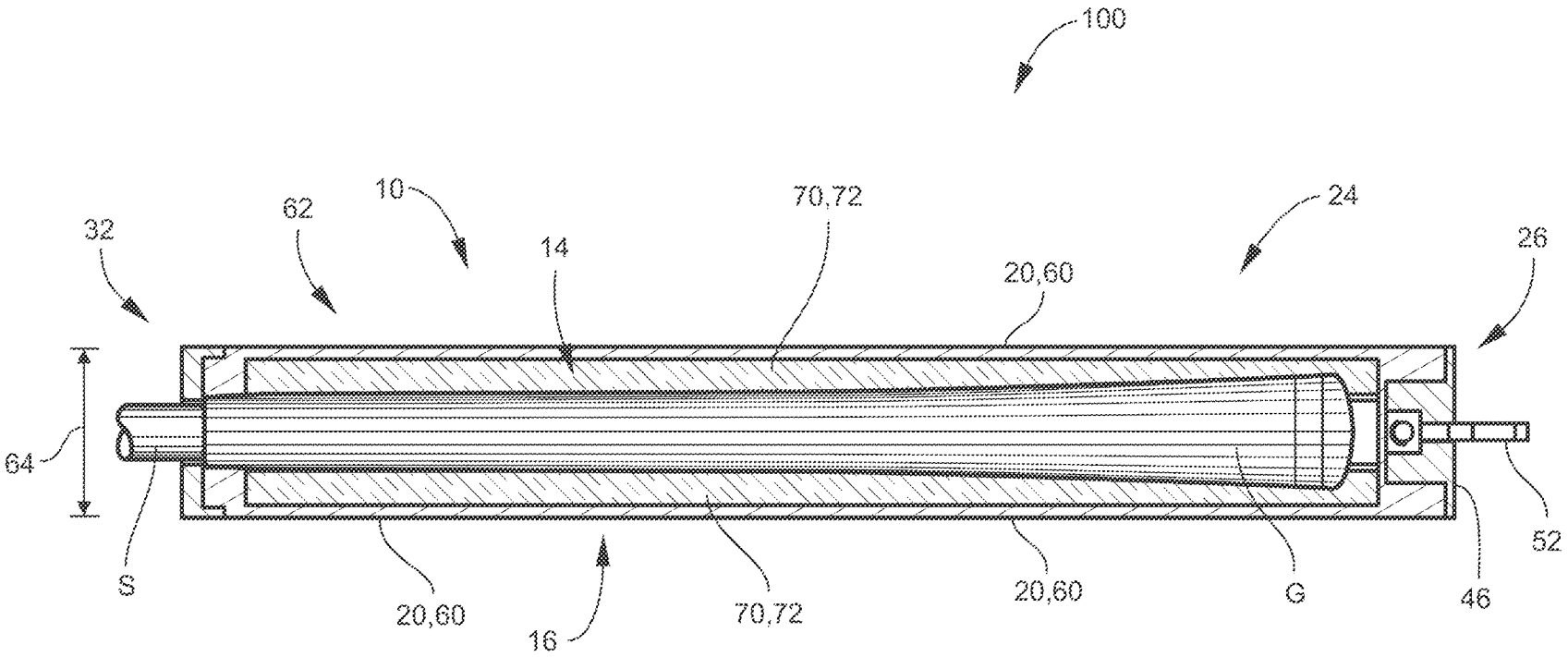
FIG. 2 is a cross-sectional view of the removable oversized golf grip and system of FIG. 1.
Figure 3:
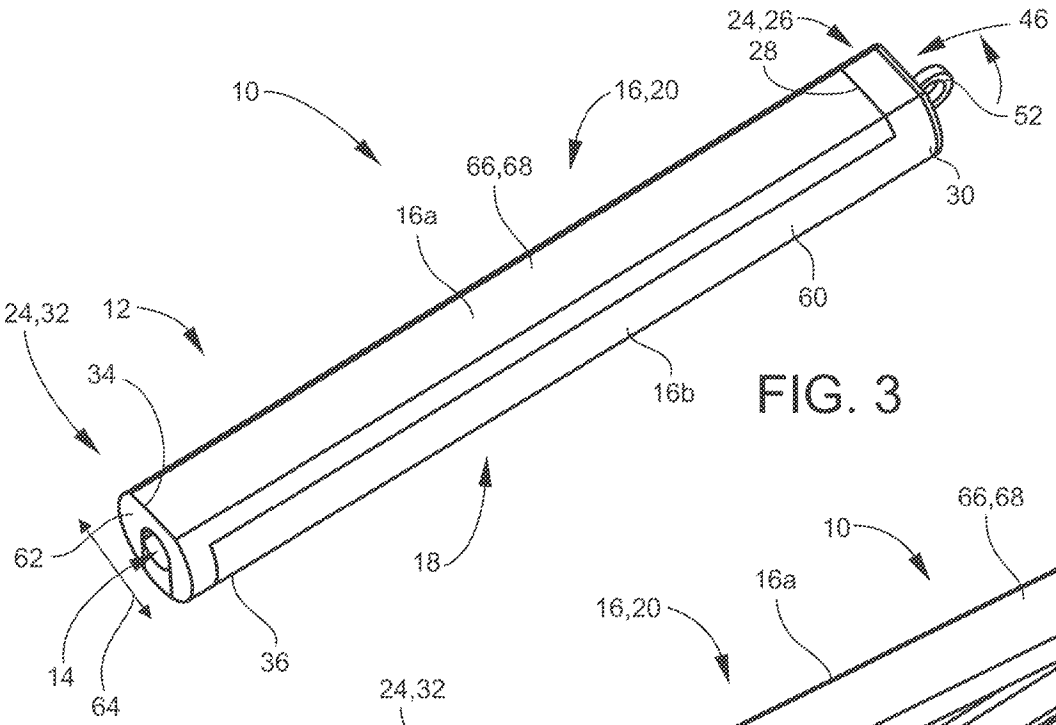
FIG. 3 is a perspective view of an exemplary embodiment of the removable oversized golf grip according to the instant disclosure.

Oversized golf grip 10 may generally include first grip portion 12 and second grip portion 18. First grip portion 12 may have first interior 14*a* and first exterior 16*a*. Second grip portion 18 may have second interior 14*b* and second exterior 16*b*. As best shown in FIG. 2, first grip portion 12 and second grip portion 18 may be configured to be removably joined together around golf grip G. When joined, first interior 14*a* and second interior 14*b* may create combined interior 14. Combined interior 14 of the first and second grip portions may be configured to securely fit around golf grip G. As used herein, securely fit may refer to the first and second grip portions 12 and 18 fitting around golf grip G securely, i.e. where oversized golf grip 10 does not easily move relative to golf grip G during normal use, i.e. chipping, putting, swinging, etc. Also when joined, first exterior 16*a* and second exterior 16*b* may create combined exterior 16. Combined exterior 16 may be configured as oversized golf grip 20. Oversized golf grip 20 may be any desired oversized golf grip. As examples, oversized golf grip 20 may be shaped and sized similar to the various Super Stroke golf grips available from SuperStroke USA of Wixom, Michigan. However, the disclosure is not so limited, and oversized golf grip 20 may be shaped and sized to any other configuration of an oversized golf grip.

Locking mechanism 24 may be included with oversized golf grip 10. Locking mechanism 24 may be for removably joining first grip portion 12 and second grip portion 18 for temporarily forming oversized golf grip 20 around golf grip G on shaft S of club C. Locking mechanism 24 may be any device or means for temporarily or removably joining first grip portion 12 and second grip portion 18. In select embodiments, locking mechanism 24 may generally include first connection 26 and second connection 32. First connection 26 may be configured for removably locking first end 28 of first grip portion 12 to first end 30 of second grip portion 18. Second connection 32 may be configured for removably locking second end 34 of first grip portion 12 to second end 36 of second grip portion 18.

Referring to FIGS. 4-7, in select embodiments, first connection 26 may include protrusion 38 from first end 28 of first grip portion 12. Protrusion 38 may include opening 40 therein. Extension 42 may be included around first end 30 of second grip portion 18. Extension 42 may create a ring around the first end 30 of second grip portion 18. Extension 42 may have space 44 therein configured to receive protrusion 38 from first end 28 of first grip portion 12. Extension 42 may be configured to receive protrusion 38 and temporarily lock protrusion 38 of first end 28 of first grip portion 12 to first end 30 of second grip portion 18.

Referring now to FIGS. 3-8B, cap 46 may be included in locking mechanism 24 of removable oversized grip 10. Cap 46 may be for temporarily locking first end 28 of first grip portion 12 to first end 30 of second grip portion 18. Cap 46 may be configured to be inserted into extension 42 on first end 30 of second grip portion 18 and to engage opening 40 in protrusion 38 from first end 28 of first grip portion 12. Cap 46 may engage opening 40 on the other side of extension 42 in first end 30 of the second grip portion, wherein the cap on one side of extension 42 and the engagement with opening 40 on the other side of extension 42 may lock first end 28 of first grip portion 12 with first end 30 of second grip portion 18.

Figure 7:
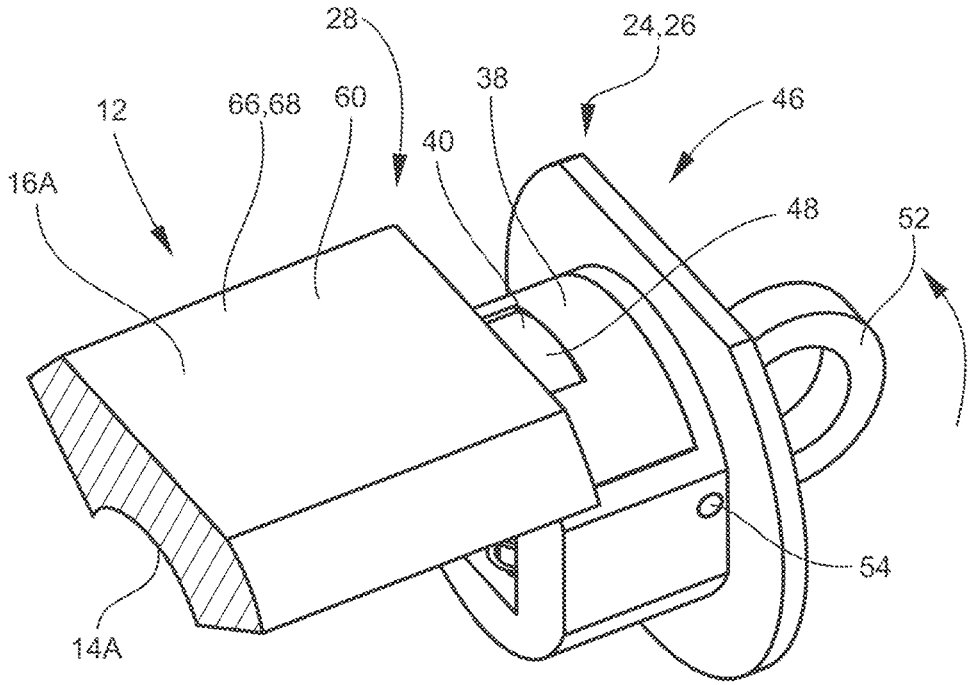
FIG. 7 is a perspective view of an exemplary embodiment of the end of the top portion and locking mechanism according to the instant disclosure.
Figure 8A:
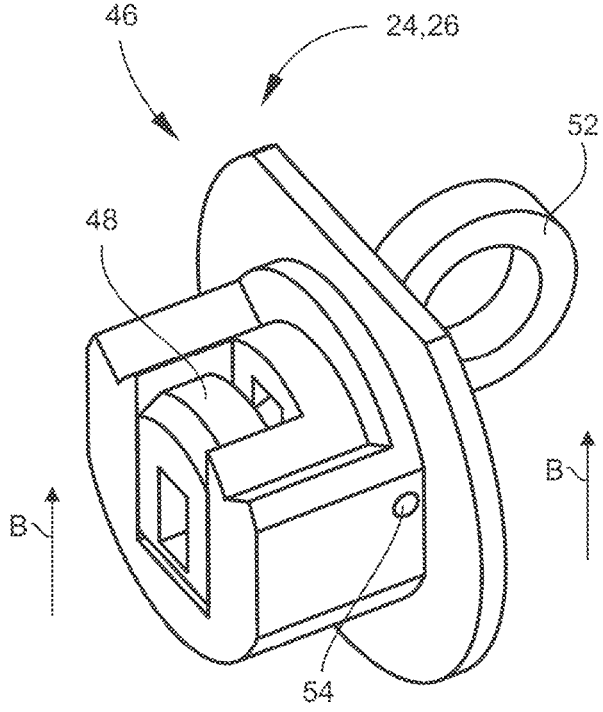
FIG. 8A is a perspective view of an exemplary embodiment of the locking mechanism according to the instant disclosure in the unlocked position.
Figure 8B:
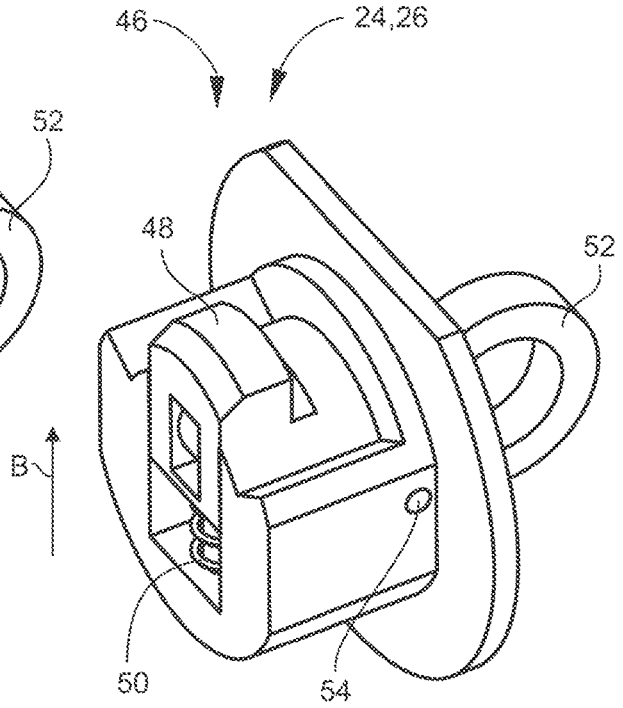
FIG. 8B is a perspective view of the exemplary embodiment of the locking mechanism from FIG. 6A in the locked position.

Referring now specifically to FIGS. 8A-8B, cap 46 may generally include tab 48. Tab 48 may be for temporarily engaging opening 40 in protrusion 38 from first end 28 of first grip portion 12. Tab 48 may be biased toward opening 40 in protrusion 38, as represented with bias directional arrow B. Tab 48 may be biased by any means, including, but not limited to spring 50, as shown in FIG. 7B. Cap 46 may also include lever 52 for moving tab 48, i.e. for disengaging tab 48 from opening 40 in protrusion 38 from first end 28 of first grip portion 12. Tab 48 may be biased toward opening 40 in protrusion 38 from first end 28 of first grip portion 12 on the other side of extension 42 in first end 30 of second grip portion 18 for temporarily locking protrusion 38 of first grip portion 12 in extension 42 of second grip portion 18. Lever 52 may be configured for moving tab 48 downwards from opening 40 and releasing protrusion 38 of first grip portion 12 from extension 42 of second grip portion 18. This movement is shown in the movement arrows of lever 52 in FIGS. 3, 4 and 7.

Figure 4:
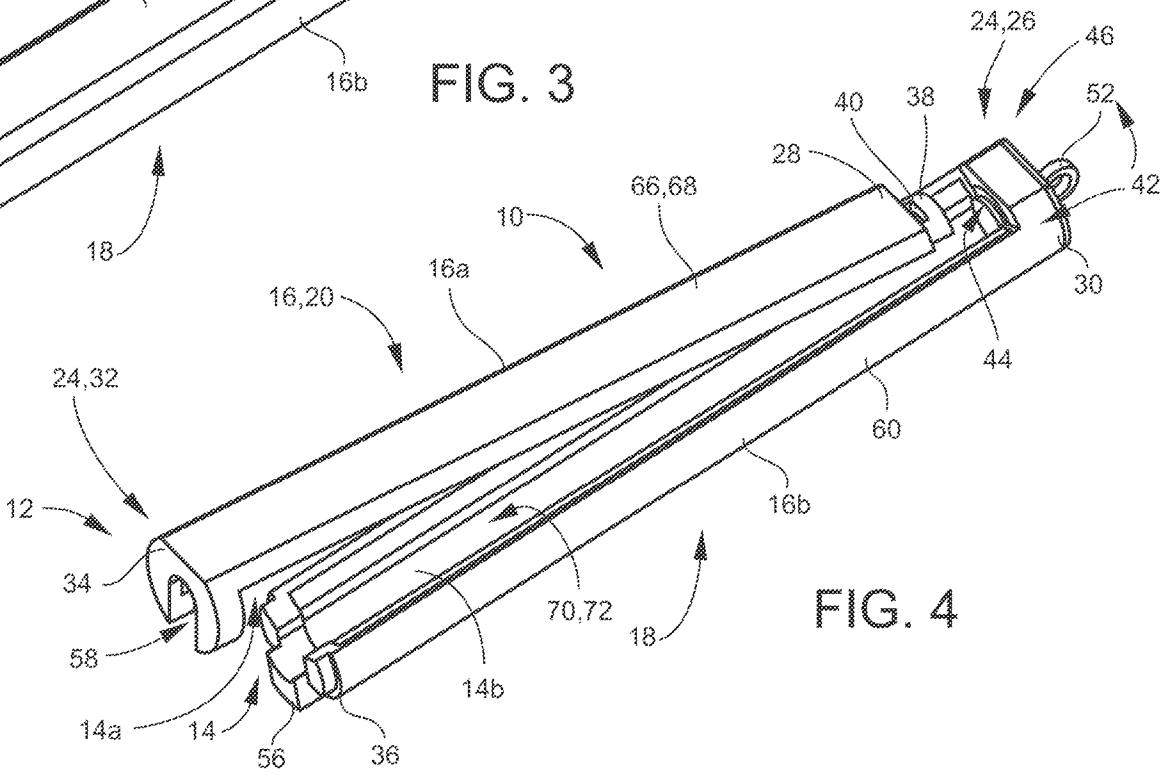
FIG. 4 is a partially disassembled perspective view of the exemplary embodiment from FIG. 3.
Figure 5:
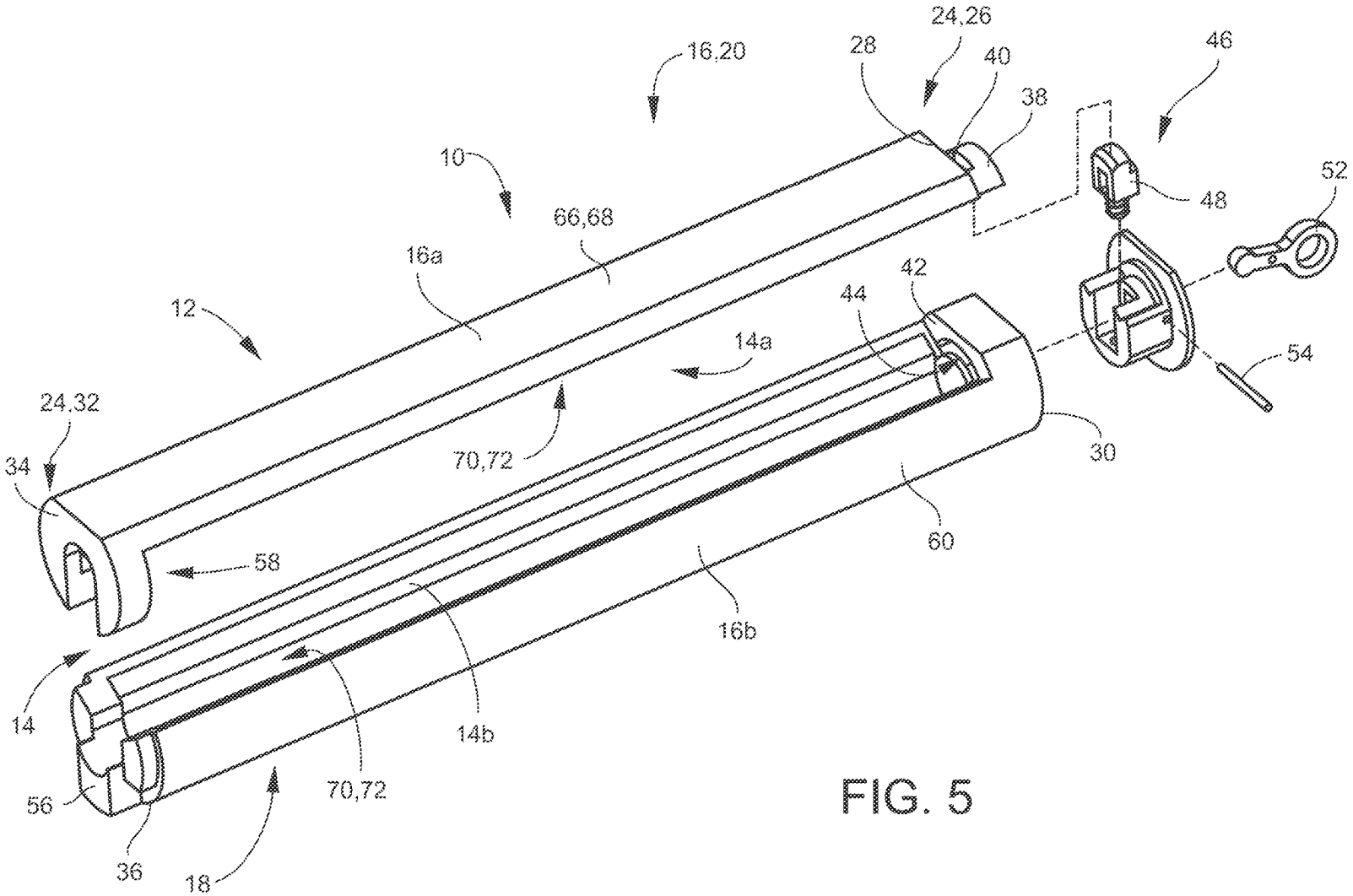
FIG. 5 is a disassembled perspective view of the exemplary embodiment from FIG. 3.
Figure 6:
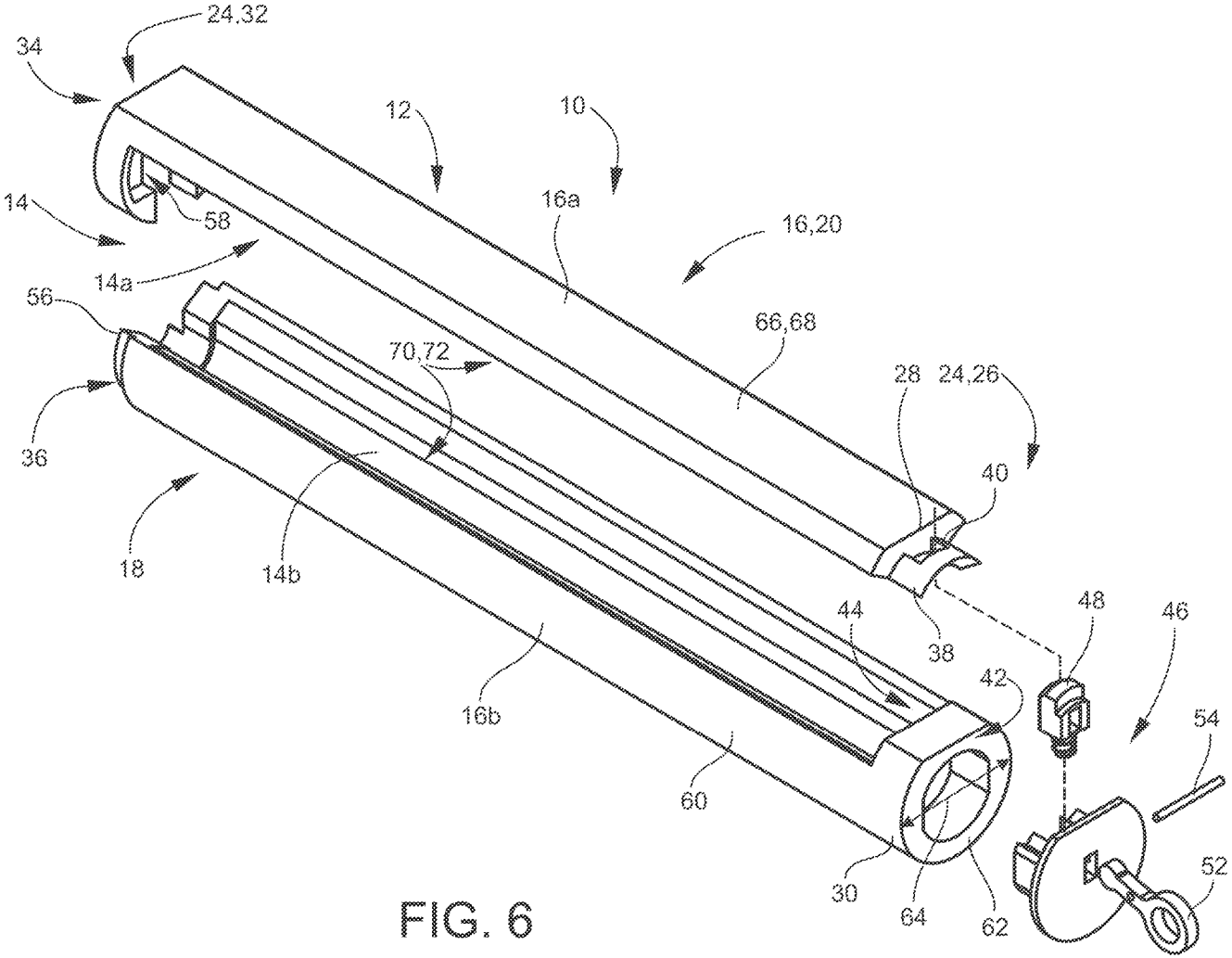
FIG. 6 is another disassembled perspective view of the exemplary embodiment from FIG. 3.

Referring to FIGS. 4-6, second connection 32 may generally include flange 56 from second end 36 of second grip portion 18, and cavity 58 on second end 34 of first grip portion 12. Cavity 58 may be configured to receive flange 56 from second end 36 of second grip portion 18. Cavity 58 may be designed and configured to releasably hold flange 56 so that second end 34 of first grip portion 12 is releasably held together with second end 36 of second grip portion 18.

Referring to FIGS. 3-6, during installation of removable oversized golf grip 10, when first grip portion 12 and second grip portion 18 are slid together around golf grip G, first connection 26 and second connection 32 may simultaneously come together, where flange 56 from second grip portion 18 may enter cavity 58 on first grip portion 12 on the second ends (34 and 36), and protrusion 38 from first grip portion 12 may simultaneously enter space 44 in extension 42 of second grip portion 18 on the first ends (28 and 30). Once slid together, cap 46 may be inserted into extension 42 of second grip portion 18, where tab 48 may be biased toward opening 40 for locking first grip portion 12 and second grip portion 18 into place. To release, lever 52 is move upwards to disengage tab 48 from opening 40, whereby first grip portion 12 may be slid away from second grip portion 18.

Oversized golf grip 20 may be created by the combined exterior 16 of first grip portion 12 and second grip portion 18, i.e. the combination of first exterior 16*a* and second exterior 16*b*. Oversized golf grip 20 may be made of any suitable or desired golf grip material, including, but not limited to, standard golf grip materials 60. Combined exterior 16 may create any desired shape or size for oversized golf grip 20. In select embodiments, combined exterior 16 may include a circular or substantially circular cross-section 62. As such, oversized golf grip 20 may have a circular cross-section, or variations thereof, i.e. more oval shapes, flat sections, etc. The circular or substantially circular cross-section 62 may have diameter 64, or a width. Diameter 64 may be any desired diameter for oversized golf grip 20. In select embodiments, diameter 64 may be at least 1.00 inches. In other select embodiments, diameter 64 may be between 1.00 inches and 2.00 inches. In yet, other possibly preferred embodiments, diameter 64 may be approximately 1.2 inches. In other select embodiments, the circular or substantially circular cross-section 62 may include at least one flat portion 66. The flat portion 66 or portions 66 may be configured in any desired direction or in any desired location around oversized golf grip 20. In select embodiments, the at least one flat portion 66 may include flat top portion 68, as shown in the Figures.

Referring to FIGS. 2 and 4-6, oversized golf grip 20 may securely fit around golf grip G on shaft S of club C by the combined interior 14 of first grip portion 12 and second grip portion 18, i.e. the combination of first interior 14*a* and second interior 14*b*, as best shown in FIG. 2. Combined interior 14 may be made of any suitable or desired material, including, flexible material 70.

Flexible material 70 of combined interior 14 may be configured to conform securely around various sizes of golf grip G or shaft S of club C. For example, but clearly not limited thereto, flexible material 70 of combined interior 14 may be configured to conform securely around a standard 0.90 inch diameter golf grip G, including various sized tapers or thickenings around the end of club G. In select embodiments, flexible material 70 may be memory foam 72. Flexible material 70, like memory foam 72, may allow combined interior 14 to not only fit around various sizes of golf grip G, but it may also secure removable oversized golf grip 10 relative to golf grip G, i.e. to prevent movement/rotation of removable oversized golf grip 10 about golf grip G during normal use (chipping, putting, swinging, etc.) Locking mechanism 24 may provide the necessary compression of first grip portion 12 to second grip portion 18 to secure removable golf grip 10 relative to golf grip G.

Referring back to FIG. 1, golf club grip system 100 for shaft S of golf club C is shown. Golf club grip system 100 may include any of the various embodiments of removable oversized golf grip 10 as shown and/or described herein. Golf club grip system 100 may generally include golf grip G installed on shaft S of golf club C, and removable oversized golf grip 10 configured to be removably installed over golf grip G installed on shaft S of golf club C. Wherein, when installed, removable oversized golf grip 10 may create oversized golf grip 20 on top of golf grip G installed on shaft S of golf club C. Oversized golf grip 20 may be used to stabilize the chipping/putting stroke of golf club C. In addition, when removable oversized golf grip 10 is removed from golf grip G of golf club C, golf club C may be operated with golf grip G for normal play, i.e. for normal or full irons and wedge shots requiring proper setting and releasing with the hands.

Figure 9:
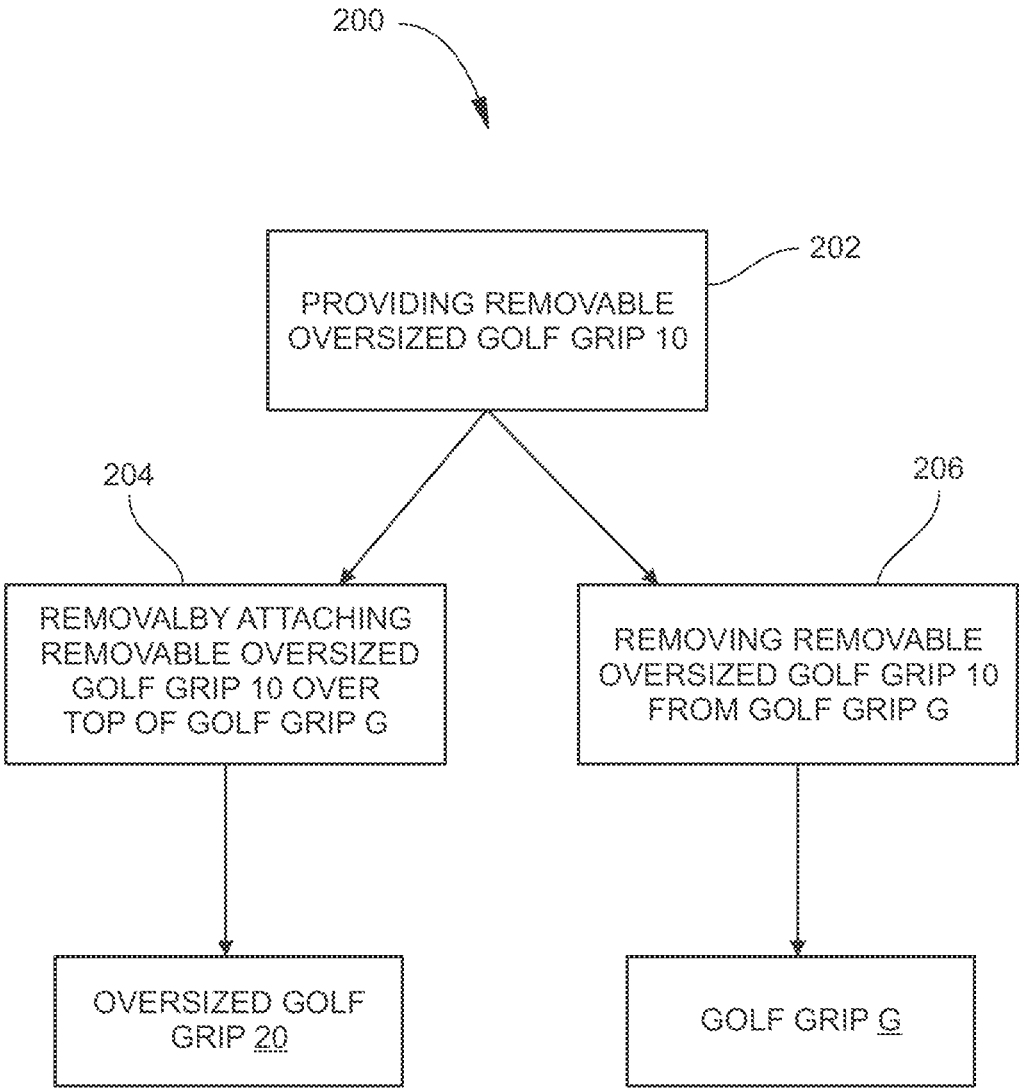
FIG. 9 is a flow diagram of an exemplary embodiment of the method of temporarily increasing the size of a golf grip installed on the shaft of a golf club according to the instant disclosure.

Referring now to FIG. 9, in use, method 200 of temporarily increasing the size of golf grip G installed on shaft S of golf club C may be carried out utilizing any of the various embodiments of removable oversized golf grip 10 as shown and/or described herein. In general, method 200 of temporarily increasing the size of golf grip G installed on shaft S of golf club C may include step 202 of providing removable oversized golf grip 10 in any of the various embodiments shown and/or described herein, where removable oversized golf grip 10 may be configured to be removably installed over golf grip G installed on shaft S of golf club C. Method 200 may then include step 204 of removably attaching removable oversized golf grip 10 over top of golf grip G installed on shaft S of golf club G. Wherein, when installed, removable oversized golf grip 10 may create oversized golf grip 20 on top of golf grip G installed on shaft S of golf club C. Method 200 may also include step 206 of removing removable oversized golf grip 10 from golf grip G. Wherein, when removed, golf club C may be operated with golf grip G for normal operation or play.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure.

Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A removable oversized golf grip comprising:

a first grip portion with a first interior and a first exterior; and a second grip portion with a second interior and a second exterior;

said first grip portion and said second grip portion are configured to be removably joined together around a golf grip, wherein said first interior and said second interior create a combined interior configured to securely fit around the golf grip, and said first exterior and said second exterior create a combined exterior configured as an oversized golf grip;

wherein the first grip portion and the second grip portion are configured to be removably joined together via a locking mechanism, the locking mechanism including:

a first connection configured for removably locking a first end of the first grip portion to a first end of the second grip portion; and a second connection configured for removably locking a second end of the first grip portion to a second end of the second grip portion;

wherein the first connection comprising:

a protrusion from the first end of the first grip portion having an opening therein;

an extension around the first end of the second grip portion with a space configured to receive the protrusion from the first end of the first grip portion; and a cap configured to be inserted into the extension on the first end of the second grip portion and to engage the opening in the protrusion from the first end of the first grip portion on the other side of the extension in the first end of the second grip portion; wherein the cap including:

a tab biased toward the opening in the protrusion from the first end of the first grip portion on the other side of the extension in the first end of the second grip portion for locking the protrusion of the first grip portion in the extension of the second grip portion; and a lever configured for moving the tab downwards from the cavity and releasing the protrusion of the first grip portion in the extension of the second grip portion.

2. The removable oversized golf grip according to claim 1, wherein the second connection comprising:

a flange from the second end of the second grip portion; and a cavity on the second end of the first grip portion configured to receive the flange from the second end of the second grip portion;

whereby, when the first grip portion and the second grip portion are slid together around the golf grip, the first connection and second connection simultaneously come together, where the flange from the second grip portion enters the cavity on the first grip portion on the second ends and the protrusion from the first grip portion simultaneously enters the space in the extension of the second grip portion on the first ends.

3. The removable oversized golf grip according to claim 1, wherein the oversized golf grip created by said combined exterior including a golf grip material with a circular or substantially circular cross-section, wherein said circular or substantially circular cross-section having a diameter of at least 1.00 inches.

4. The removable oversized golf grip according to claim 3, wherein the diameter is between 1.00 inches and 2.00 inches.

5. The removable oversized golf grip according to claim 4, wherein the diameter is approximately 1.2 inches.

6. The removable oversized golf grip according to claim 3, wherein the circular or substantially circular cross-section including at least one flat portion.

7. The removable oversized golf grip according to claim 6, wherein the at least one flat portion including a flat top portion.

8. The removable oversized golf grip according to claim 1, wherein the combined interior including a flexible material configured to conform securely around various sizes of the golf grip.

9. The removable oversized golf grip according to claim 8, wherein the flexible material of the combined interior is configured to conform securely around a 0.90 inch diameter golf grip.

10. The removable oversized golf grip according to claim 8, wherein the flexible material is a memory foam.

11. A golf club grip system for a shaft of a golf club comprising:

a golf grip installed on the shaft of the golf club; and a removable oversized golf grip configured to be removably installed over the golf grip installed on the shaft of the golf club;

wherein, when the removable oversized golf grip is installed over the golf grip on the shaft of the golf club, the removable oversized golf grip creates an oversized golf grip on top of the golf grip;

wherein said removable oversized golf grip comprising:

a first grip portion with a first interior and a first exterior; and a second grip portion with a second interior and a second exterior;

said first grip portion and said second grip portion are configured to be removably joined together around the golf grip via a locking mechanism, wherein said first interior and said second interior create a combined interior configured to securely fit around the golf grip, and said first exterior and said second exterior create a combined exterior configured as the oversized golf grip;

wherein the locking mechanism including:

a first connection configured for removably locking a first end of the first grip portion to a first end of the second grip portion; and a second connection configured for removably locking a second end of the first grip portion to a second end of the second grip portion;

wherein the first connection comprising:

a protrusion from the first end of the first grip portion having an opening therein;

an extension around the first end of the second grip portion with a space configured to receive the protrusion from the first end of the first grip portion; and a cap configured to be inserted into the extension on the first end of the second grip portion configured to engage the opening in the protrusion from the first end of the first grip portion on the other side of the extension in the first end of the second grip portion, the cap including:

a tab biased toward the opening in the protrusion from the first end of the first grip portion on the other side of the extension in the first end of the second grip portion for locking the protrusion of the first grip portion in the extension of the second grip portion; and a lever for moving the tab downwards from the opening and releasing the protrusion of the first grip portion in the extension of the second grip portion; and wherein the second connection comprising:

a flange from the second end of the second grip portion; and a cavity on the second end of the first grip portion configured to receive the flange from the second end of the second grip portion;

whereby, the first connection and the second connection simultaneously come together, where the flange from the second grip portion enters the cavity on the first grip portion on the second ends and the protrusion from the first grip portion enters the space in the extension of the second grip portion on the first ends.

12. The golf club grip system according to claim 11, wherein the oversized golf grip including a standard golf grip material with a circular or substantially circular cross-section, wherein said circular or substantially circular cross-section having a diameter of at least 1.00 inches, wherein the circular or substantially circular cross-section including at least one flat portion including a flat top portion.

13. The golf club grip system according to claim 11, wherein the combined interior including a flexible material configured to conform securely around the golf grip.

14. A method of temporarily increasing the size of a golf grip installed on a shaft of a golf club comprising:

providing a removable oversized golf grip configured to be removably installed over the golf grip installed on the shaft of the golf club, the removable oversized golf grip comprising:

a first grip portion with a first interior and a first exterior; and a second grip portion with a second interior and a second exterior;

said first grip portion and said second grip portion are configured to be removably joined together around a golf grip, wherein said first interior and said second interior create a combined interior configured to securely fit around the golf grip, and said first exterior and said second exterior create a combined exterior configured as an oversized golf grip;

wherein the first grip portion and the second grip portion are configured to be removably joined together via a locking mechanism, the locking mechanism including:

a first connection configured for removably locking a first end of the first grip portion to a first end of the second grip portion; and a second connection configured for removably locking a second end of the first grip portion to a second end of the second grip portion;

wherein the first connection comprising:

a protrusion from the first end of the first grip portion having an opening therein;

an extension around the first end of the second grip portion with a space configured to receive the protrusion from the first end of the first grip portion; and a cap configured to be inserted into the extension on the first end of the second grip portion and to engage the opening in the protrusion from the first end of the first grip portion on the other side of the extension in the first end of the second grip portion; wherein the cap including:

a tab biased toward the opening in the protrusion from the first end of the first grip portion on the other side of the extension in the first end of the second grip portion for locking the protrusion of the first grip portion in the extension of the second grip portion; and a lever configured for moving the tab downwards from the cavity and releasing the protrusion of the first grip portion in the extension of the second grip portion; and removably attaching the removable oversized golf grip over top of the golf grip installed on the shaft of the golf club wherein, when installed the removable oversized golf grip creates an oversized golf grip on top of the golf grip installed on the shaft of the golf club.

* * * * *